US010969092B1

(12) United States Patent
Zhang et al.

(10) Patent No.: US 10,969,092 B1
(45) Date of Patent: Apr. 6, 2021

(54) DEFORMABLE HIGH-POWER LIGHT FIXTURE

(71) Applicant: Shenzhen Huadian Lighting Co., Ltd., Guangdong (CN)

(72) Inventors: Wenyi Zhang, Guangdong (CN); Wanbang Luo, Sichuan (CN)

( * ) Notice: Subject to any disclaimer, the term of this patent is extended or adjusted under 35 U.S.C. 154(b) by 0 days.

(21) Appl. No.: 16/742,863

(22) Filed: Jan. 14, 2020

(30) Foreign Application Priority Data

Dec. 30, 2019 (CN) ..... 201911391137.3

(51) Int. Cl.

| | |
|---|---|
| ***F21V 23/02*** | (2006.01) |
| ***F21S 8/00*** | (2006.01) |
| ***F21V 29/75*** | (2015.01) |
| ***F21V 21/30*** | (2006.01) |
| *F21V 31/00* | (2006.01) |

(52) U.S. Cl.
CPC ..... *F21V 23/023* (2013.01); *F21S 8/03* (2013.01); *F21V 21/30* (2013.01); *F21V 29/75* (2015.01); *F21V 31/005* (2013.01)

(58) Field of Classification Search
CPC .. F21V 23/003–026; F21S 8/036; F21S 8/043
See application file for complete search history.

(56) References Cited

U.S. PATENT DOCUMENTS

2017/0167695 A1* 6/2017 Erdener ..... F21V 19/02
2018/0266670 A1* 9/2018 Deng ..... F21V 31/005

* cited by examiner

*Primary Examiner* — Sean P Gramling
(74) *Attorney, Agent, or Firm* — Prakash Nama; Global IP Services, PLLC

(57) ABSTRACT

The invention discloses a deformable high-power light fixture, which includes a light fixture body, a bracket assembly and other assemblies. The light fixture body includes a light source plate, a heat-dissipating body and a power supply box. The assemblies can be detachable from or sent externally away from the light fixture body. The bracket assembly can be detachable from the main light fixture body also, and it can rotate around its connection point with the light fixture body. The main light fixture body is provided with a glare shield. The present invention uses a common body to achieve various shape changes by splicing, which saves the investment of molds in the early stage and the cost of material preparation in the later stage, so that users can complete the assembly and replacement only by purchasing a single accessory. On the one hand, the glare shield can increase the reflectivity and reduce light loss. On the other hand, it reduces the irritation of light to the human eyes, and also increase the adjustable irradiation area; the light fixture uses a stepless speed dial to achieve fine adjustment of the illumination angle; the bracket assembly can be replaced, and compatible with the tubular installation, supporting pipe diameter 60-86 mm.

3 Claims, 9 Drawing Sheets

DEFORMABLE HIGH-POWER LIGHT FIXTURE

BACKGROUND OF THE INVENTION

The invention relates to the technical field of high-power fixture, and more particularly, to a deformable high-power lighting fixture.

The existing high-power light fixtures are often used in stadiums, docks or construction sites, and are suitable for different industries. Due to the different fields involved, different customers have different needs for lighting fixtures, such as the shape of the light fixture, the wiring method when adding special functions, the shape and installation of the bracket, the placement of the power box, etc. In order to decrease the cost of customer and investment of our own company, a light fixture that can be compatible with various customers is needed.

Due to the large area of the premises, the luminaire installation is generally at a height of more than 30 meters, and the existing angle adjustment structure and method of the luminaire have been unable to accurately achieve the adjustment effect.

In addition, high-power light fixtures are generally prone to glare due to their relatively high power, which is discomfort to human eyes.

The above deficiencies need to be improved.

BRIEF SUMMARY OF THE INVENTION

In order to overcome the shortcomings of the prior art, the present invention provides a deformable high-power light fixture.

The technical solution of the present invention is described as follows:

A deformable high-power light fixture includes a fixture body, a bracket assembly, and an assembly. The fixture body includes a light source plate, a heat-dissipating body, and a power supply box. The assembly and the fixture body are characterized in that: The assembly is detachably connected and disposed outside the main fixture body, the bracket assembly is detachably connected with the main fixture body, the bracket assembly rotates around its connection point with the main fixture body, and the main fixture body is provided with a glare shield.

In the above-mentioned deformable high-power light fixture, a plurality of circular protrusions are provided on the inner wall of the glare shield.

In the above-mentioned deformable high-power light fixture, the power supply box is externally connected to a junction box, and the junction box is fixed to the power supply box by bolts. The power supply box can be used as a flip handle.

In the above-mentioned deformable high-power light fixture, a circular arc handle is provided on the top of the power supply box.

In the above-mentioned deformable high-power light fixture, the bracket assembly includes a stepless speed dial, a support bracket and a fastening piece, and the stepless speed dial is connected to the support bracket through a fastening screw, and the fastening piece is connected to the stepless speed dial by passing through the support bracket, and the support bracket is connected to the power supply box by a fixed bracket.

Further, one side of the fastening sheet is provided with embossing and positioning pins, and the other side is provided with a fixing nut, the fastening piece is connected with the support bracket through the positioning pins, and the embossing is closely attached to the stepless speed dial, and the fastening piece is connected with the support bracket through the fixing nut.

Still further, the support bracket is provided with a fixing hole, and a handle screw passes through the fixing hole and the fixing nut, so that the support bracket is connected with the fastening piece.

Still further, the handle screw includes a screw tooth portion and a handle portion, and the screw tooth portion is connected to the fixing nut.

Further, one surface of the stepless speed dial is concave, and the other surface and the concave surface are both smooth planes, and the embossing is closely attached to the concave surface, so that the fastening piece and the stepless speed dial is fixedly connected.

Further, a scale is provided on the stepless speed dial.

Further, a via hole is provided in the center of the stepless speed dial, and an adjusting cylinder is provided in the via hole, and the fastening screw passes through the stepless speed dial and the adjusting cylinder, and the fixing bracket, so that the support bracket is respectively connected to the stepless speed dial and the fixed bracket.

Still further, the adjusting cylinder abuts against the fixing bracket.

Still further, a spring pad and a flat pad are provided between the fastening screw and the stepless speed dial.

In the above-mentioned deformable high-power light fixture, the screw holes are provided on the light fixture body, and the assembly is connected to the light fixture body by screws.

In the above-mentioned deformable high-power light fixture, the power supply box and the heat-dissipating light fixture body are connected by screws.

In the above-mentioned deformable high-power light fixture, the main body of the fixture is circular.

In the aforementioned deformable high-power light fixture, the assembly has a square corner shape.

In the above-mentioned deformable high-power light fixture, the power supply box includes a bottom cover, a driving power supply, and a power supply box upper cover. The power supply box bottom cover and its upper cover are connected by screws, and the driving power supply is set inside the space enclosed by the bottom and upper cover of the power supply box.

Further, a waterproof rubber ring is arranged between the upper cover and the bottom cover of the power supply box.

In the above-mentioned deformable high-power light fixture, the light source plate is covered with a transparent lens.

Further, a waterproof rubber ring is provided between the lens and the light source plate.

In the above-mentioned deformable high-power light fixture, the bracket assembly includes an upper base and a base, the upper base is fixedly connected to the light fixture body, the upper base and the base are meshed and fixed by fixing bolts.

Further, the right lower part of the upper base is with embossing and a ring-shaped left thread provided on the left side and a bolt hole provided in the center thereof; the left upper part of the base is with embossing also and a ring-shaped right thread provided on the right side and a bolt hole provided in the center thereof; the left thread and the right thread are meshed and connected, and the fixing bolt passes through the bolt hole of the upper base and the bolt hole of the base, so that the left thread and the right thread do not slide relatively.

Still further, by adjusting the engagement angle of the left and right threads, by changing the angle between the upper base and the base, the angle between the light fixture body and the base is changed therefore.

Further, a plurality of positioning bolt holes are provided on the side of the base, and a step hole is provided at the bottom of the base. The base is sleeved on the upper part of the light pole through the step holes, and the positioning bolt is inserted into the positioning bolt hole and squeeze the light pole inside the base, so that the base is fixedly connected with the light pole.

Further, the bottom of the base is provided with a plurality of arc-shaped angle adjusting grooves, and the adjusting bolt passes through the angle adjusting grooves to fix the base on the wall surface.

Still further, by rotating the base, by changing the position of the adjustment bolt in the angle adjustment groove, the illumination angle of the light fixture is changed.

The present invention according to the above scheme has the beneficial effects that:

1. Using a common body, the various shapes can be changed by splicing, which saves the initial mold investment and the later material preparation cost, so that users can complete the assembly and replacement by purchasing a single accessory;

2. Adding a glare mask, on the one hand, increases the light reflectivity and reduces light loss, on the other hand, it reduces the stimulation of light on the human eyes, and can also increase the adjustable irradiation area;

3. The power box is externally installed, and the placement of the power box can be adjusted arbitrarily without affecting the use of the light fixture;

4. Adding arc handles, convenient for users to open the cover;

5. The light fixture adopts a stepless speed dial, which can realize the fine adjustment of the angle of the fixture;

6. The bracket assembly is replaceable, compatible with tubular installation, and supports a diameter of 60-86 mm.

BRIEF DESCRIPTION OF THE DRAWINGS

In order to explain the technical solutions in the embodiments of the present invention more clearly, the drawings used in the embodiments or the description of the prior art will be briefly introduced below. Obviously, the drawings in the following description are only the present invention. In some embodiments, for those of ordinary skill in the art, other drawings may be obtained based on these drawings without paying creative labor.

Figure 1:
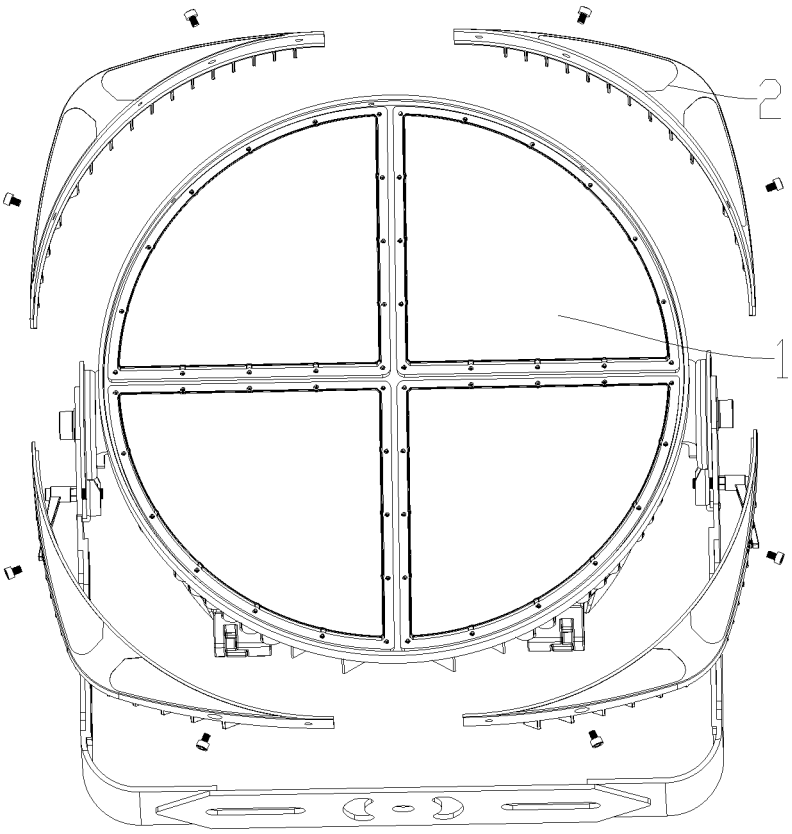
FIG. 1 is an exploded view of the structure of the light fixture body and the assembly.

Among them, each reference numeral in the figure:

1. Light body;

11. Power supply box; 111. Power supply box cover; 112. Drive power supply; 113. Power supply box bottom cover; 114. Waterproof rubber ring; 12. Cooling light fixture body; 13. Light source board; 14. Lens; 141. Waterproof rubber ring for lens; 15. Junction box; 16. Arc handle; 17. Glare shield;

2. Assembly pieces;

3. The first bracket assembly; 31. Stepless speed dial; 311. Inner flat plane; 312. Scale; 32. Fixed bracket; 33. Adjusting cylinder; 34. Support bracket; 35. Fastening piece. 351. Positioning nails. 352. Embossing; 353. Fixing nut; 36. Handle screw; 361. Handle part; 362. Screw tooth part; 37. Fastening screw;

4. The second bracket assembly; 41. Upper base; 42. Base; 43. Step holes; 44. Positioning bolts; 45. Fixing bolts; 46. Angle adjustment grooves; 47. Adjustment bolts;

5. Wall surface.

DETAILED DESCRIPTION OF THE INVENTION

In order to make the technical problems, technical solutions and beneficial effects, which are to be solved by the present invention, more clear, the present invention will be further described in detail below with reference to the accompanying drawings and embodiments. It should be understood that the specific embodiments described herein are only used to explain the present invention and are not intended to limit the present invention.

It should be noted that when a component is called "fixed" or "set" or "connected" with another component, it can be directly or indirectly located on the other component. The directions or positions indicated by the terms "up", "down", "left", "right", "front", "rear", "top", "bottom", "inside", "outside", etc. are based on the drawings The orientations or positions shown are for convenience of description only, and should not be construed as limiting the technical solution. The terms "first" and "second" are only used for descriptive purposes, and cannot be understood as indicating or implying relative importance or implicitly indicating the number of technical features. The meaning of "plurality" is two or more, unless specifically defined otherwise. The meaning of "several" is one or more, unless specifically defined otherwise.

Figure 5:
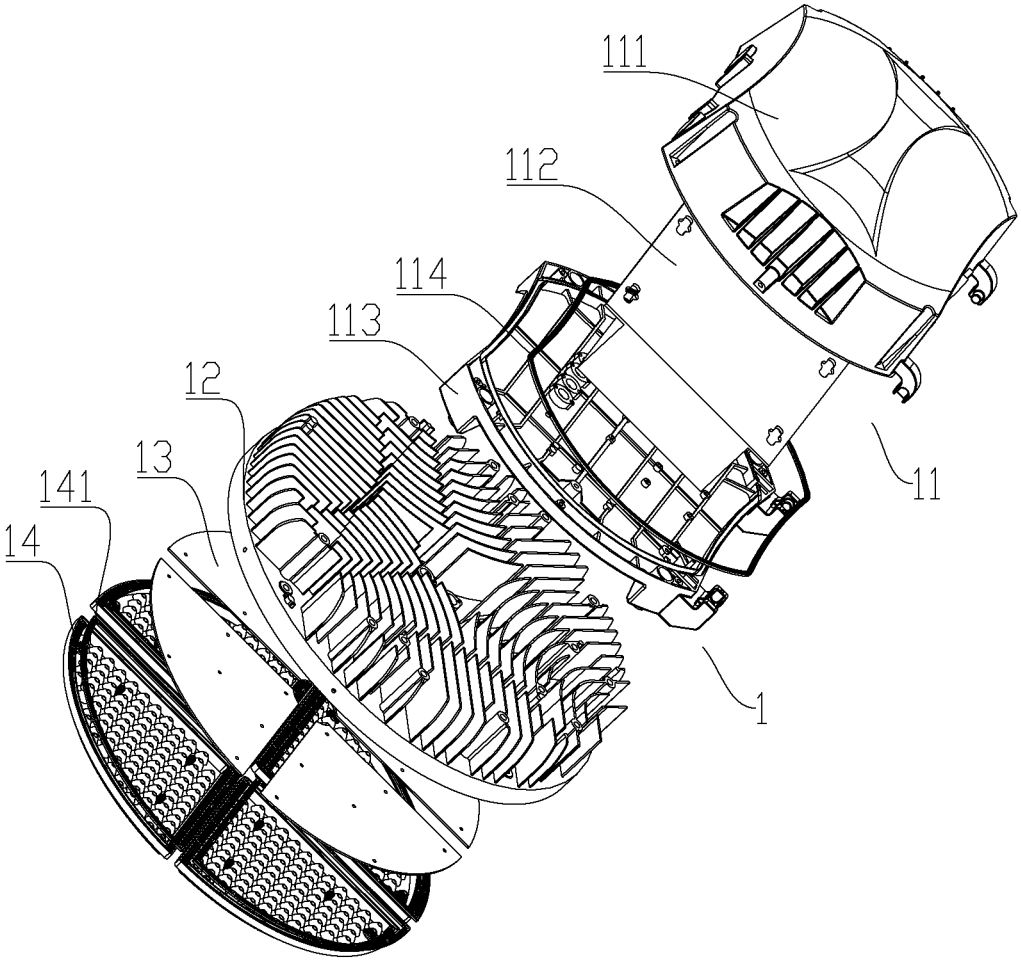
FIG. 5 is a schematic exploded view of the structure of the light fixture body.

A deformable high-power light fixture, as shown in FIG. 1 and FIG. 5, includes a light fixture body 1, a bracket assembly and an assembly 2. The light fixture body 1 includes a light source plate 13, a heat-dissipating light fixture body 12 and a power supply box 11. The assembly 2 is detachably connected to the main light fixture body 1 and is disposed outside the main light fixture body 1. The bracket assembly is detachably connected to the main light fixture body 1. The bracket assembly rotates around its connection with the main light fixture body 1. The main light fixture body is provided with glare shields 17.

As shown in FIG. 1, the light fixture body 1 has a circular shape, and the assembly 2 has a square corner shape. The light fixture main body 1 is provided with screw holes, and the assembly 2 is connected to the light fixture main body 1 by screws. In this way, the assembly 2 is fixed to the light fixture main body 1 by screws to form a new square light fixture. In addition, the assembly 2 can also be changed into other corners of different shapes, and a circular light fixture body 1 is used as the center to form various light fixtures with different shapes.

Figure 2:
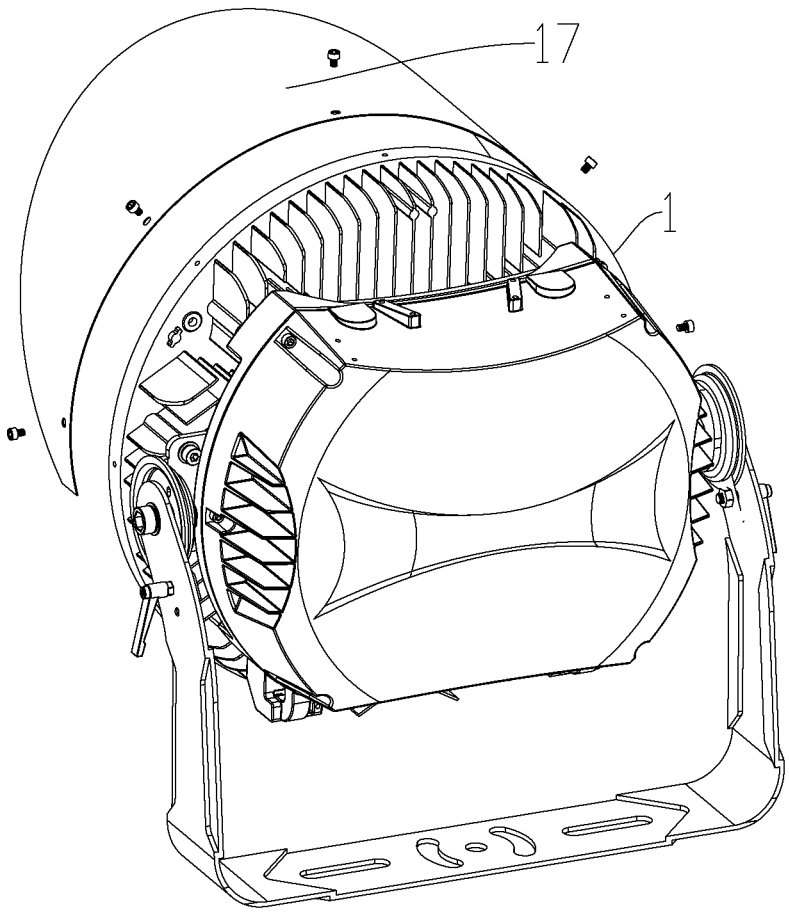
FIG. 2 is a schematic exploded view of the structure of the light fixture body and the glare shield.

As shown in FIG. 2, there are holes around the light fixture body 1, and the glare shield 17 is fixed to the light fixture body 1 by screws. The inner wall of the glare shield 17 is provided with a plurality of circular protrusions. On the one hand, it increases the reflectivity of light and reduces the light loss. On the other hand, the light is softened by the refraction of the small protrusions, which reduces the stimulation of light on the human eyes. At the same time, the glare shield 17 can also adjust the irradiation area, which effectively prevents the upward waste of light and increases the light utilization efficiency.

As shown in FIG. 5, the power supply box 11 includes a power supply box bottom cover 113, a driving power supply 112 and a power supply box top cover 111. The power supply box bottom cover 113 and the power supply box top cover 111 are fastened and connected. The driving power supply 112 is provided in a space surrounded by the bottom cover 113 and the top cover 111 of the power supply box. A waterproof rubber ring 114 is provided between the upper cover 111 and the bottom cover 113 of the power supply box. The power supply box 11 and the heat-dissipating light fixture body 12 are connected by screws. In other embodiments, if the light pole has a load bearing requirement, the power supply box 11 will be placed in a ground electric box.

Figure 3:
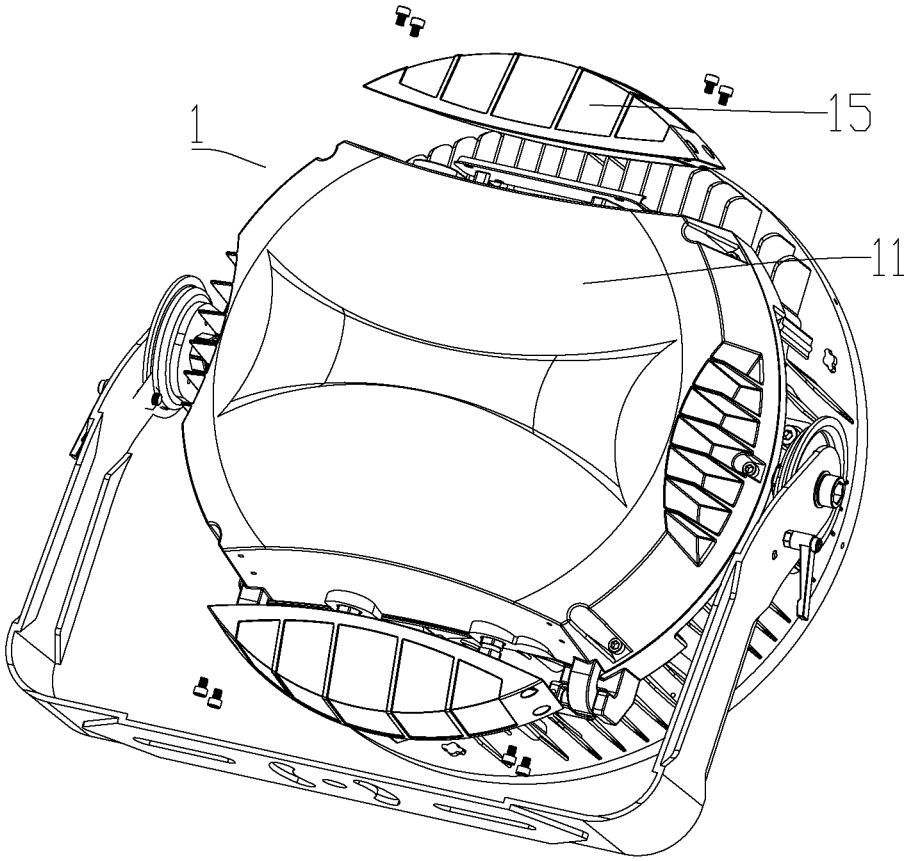
FIG. 3 is an exploded view of the structure of the light fixture body and the junction box.

As shown in FIG. 3, the power supply box 11 is externally connected to the junction box 15, and the junction box 15 is fixed to the power supply box 11 by bolts to meet the requirements of special functions added by other customers. In addition, the power supply box 11 can be used as a flip handle.

Figure 4:
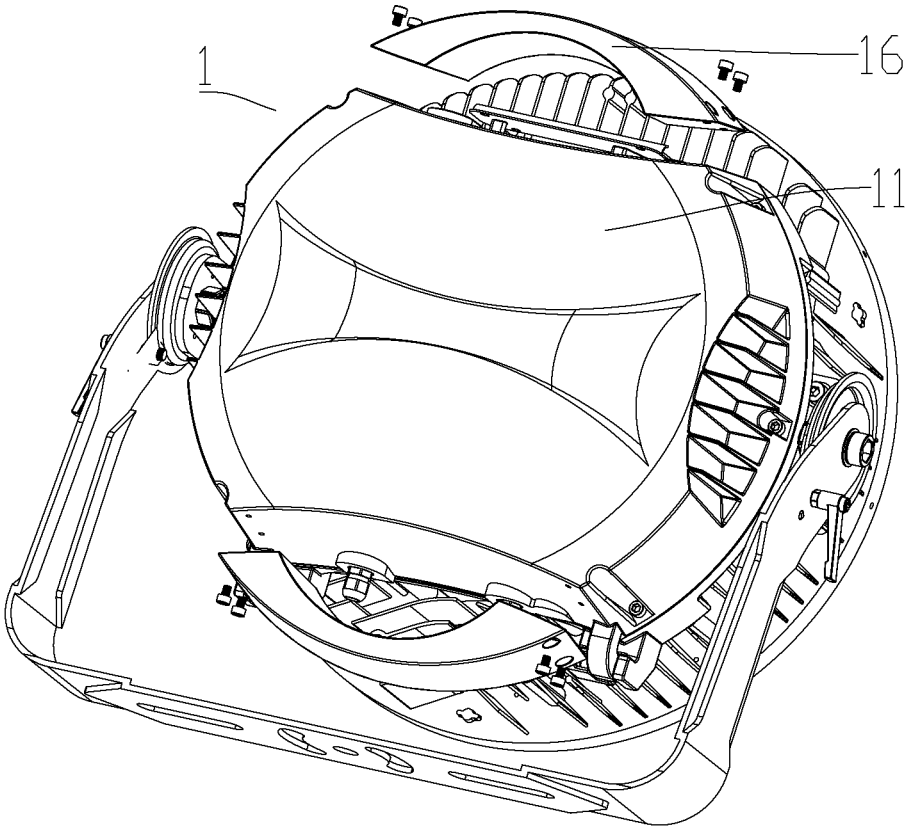
FIG. 4 is an exploded view of the structure of the light fixture body and the arc handle.

As shown in FIG. 4, a circular arc handle 16 is provided on the top of the power supply box 11.

As shown in FIG. 5, the light source plate 13 is covered with a lens 14, and a lens waterproof rubber ring 141 is provided between the lens 14 and the light source plate 13.

When assembling, firstly fix the light source plate 13 to the front of the heat sink body 12 with screws, the lens waterproof rubber ring 141 is embedded in the lens 14, and then cover the light source board 13 with screws; then the support bracket 34 is fixed to the heat sink body 12 with screws. The bottom cover 113 of the power box is fixed to the back of the heat-dissipating light fixture body 12 by screws. The waterproof rubber ring 114 is embedded in the power box bottom cover 113. The driving power supply 112 is fixed on the top cover 111 of power box by screws and then wholly placed on bottom cover 113 of the power supply box; the stepless speed dial 31 is fixed to the support bracket 34 by screws, the fixing bracket 32 is fixed to the stepless speed dial 31 by screws. There are stepped surfaces at both ends of the fastening piece 35. Through the handle screw 36, one end is in contact with the stepless speed dial 31, and the other end is connected with the support bracket 34. The illumination angle of the light fixture can be adjusted by the tightening of the handle screw 36, and the light fixture assembly is completed then.

Figure 6:
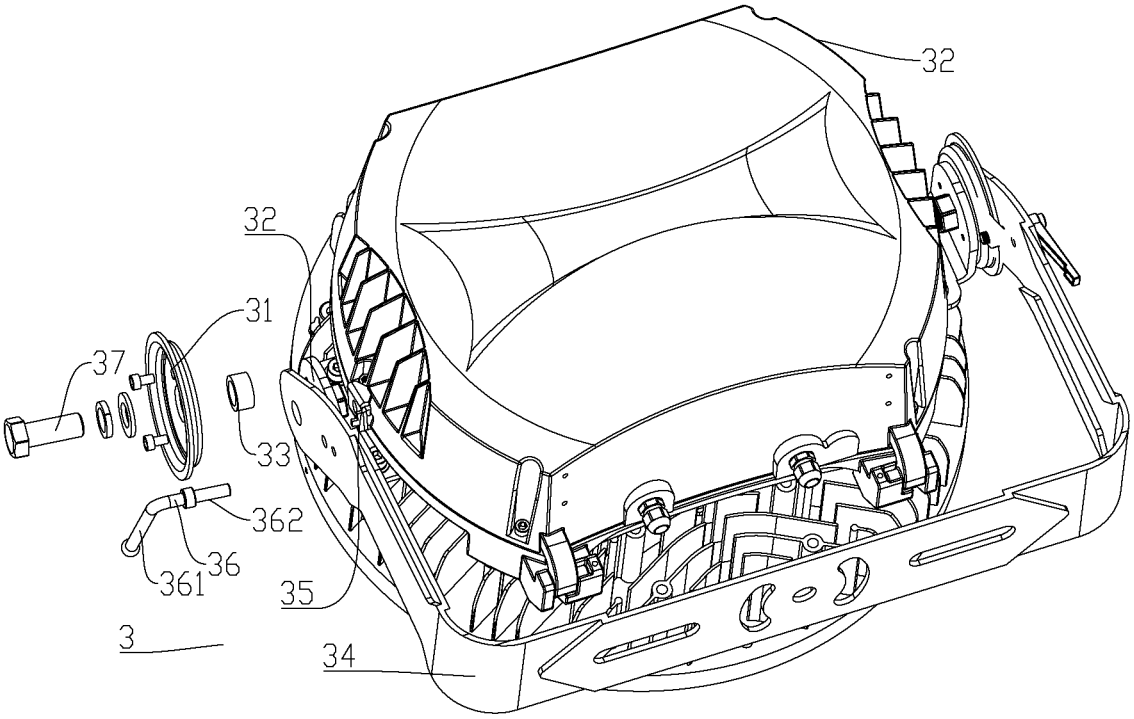
FIG. 6 is an exploded view of the structure of the first bracket assembly.

As shown in FIG. 6, in the first embodiment, the first bracket assembly 3 includes a stepless speed dial 31, a support bracket 34, and a fastening piece 35. The stepless speed dial 31 is connected to the support bracket 34 through the fastening screw 37. The fixing piece 35 is connected to the stepless speed dial 31 through the support bracket 34, and the support bracket 34 is connected to the power supply box 11 through the fixing bracket 32.

The support bracket 34 is provided with fixing holes, and the handle screw 36 passes through the fixing hole and the fixing nut 353 to connect the support bracket 34 with the fastening piece 35. The handle screw 36 includes a threaded portion 362 and a handle portion 361. The threaded portion 362 is connected to the fixing nut 353.

Figure 7:
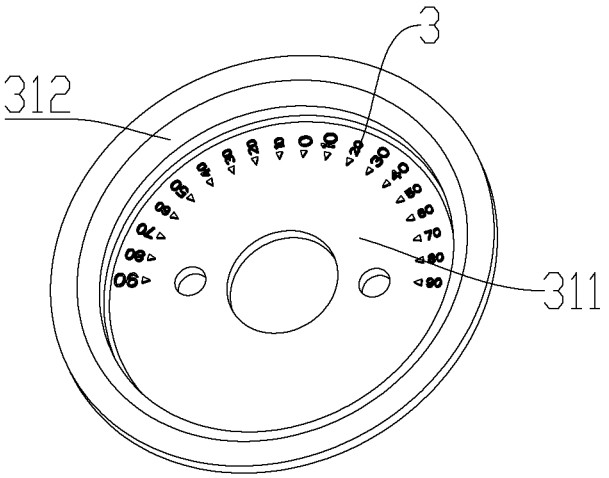
FIG. 7 is a schematic structural diagram of a stepless speed dial.

As shown in FIG. 7, one side of the stepless speed dial 31 is concave, and the other side and concave surfaces are smooth planes. The concave surface is an internal flat plane 311, and the embossing 352 is closely abutted in the concave surface for fastening the sheet 35 and the stepless speed dial 31. A stepless speed dial 31 is provided with a scale 312 for adjusting the illumination angle of the light fixture.

The center of the stepless speed dial 31 is provided with a via hole. The diameter of the hole of the stepless speed dial 31 is larger than the diameter of the adjustment cylinder 33. The via hole is provided with an adjustment cylinder 33. The fastening screw 37 passes through the stepless speed dial 31 and the adjustment cylinder 33 and the fixed bracket 32, so that the support bracket 34 is connected to the stepless speed governor 31 and the fixed bracket 32, respectively. The adjusting cylinder 33 abuts against the fixing bracket 32. A spring washer and a flat washer are provided between the fastening screw 37 and the stepless speed governor 31.

Figure 8:
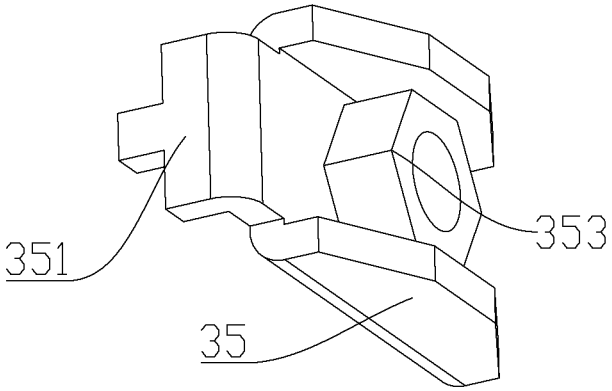
FIG. 8 is a first structural schematic view of the fastening piece.
Figure 9:
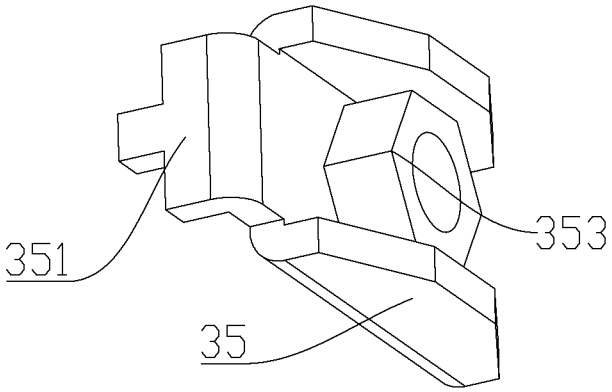
FIG. 9 is a second structural diagram of the fastening piece.

As shown in FIGS. 8 and 9, one side of the fastening piece 35 is provided with an embossing 352 and a positioning pin 351 as a fastening plane, and the other side is provided with a fixing nut 353. The fastening piece 35 passes the positioning pin 351 and the support bracket 34 for connection, the embossing 352 is closely attached to the stepless speed governor 31, and the fastening piece 35 is connected to the support bracket 34 through a fixing nut 353.

As shown in FIG. 6, during operation, fix the stepless speed dial 31 to the main light fixture body 1 and the fixing bracket 32 by the fixing screws and pass the adjusting cylinder 33 through the middle hole of the stepless speed dial 31 and fixed it on the fixing bracket 32. The diameter of the via hole is larger than the diameter of the adjusting cylinder 33, and the diameter of the adjusting cylinder 33 is larger than the diameter of the fixed screw hole of the fixing bracket 32. Then, lock the support bracket 34 and the stepless speed governor 31 with screws, pass the positioning pin 351 on the fastening piece 35 through the fixing hole on the support bracket 34, and attach the fastening plane to the inner flat plane 311 of the stepless governor 31, and then pass the screw portion 362 of the handle screw 36 through the via hole of the support bracket 34 and lock on the fixing nut 353 of the fastening piece 35. Then adjust the light fixture body 1 up and down to the required angle, and then tighten the handle screw 36. When tightening the handle screw 36, the screw portion 362 of the handle screw 36 will tighten the fastening piece 35, and the fastening plane will get close to the inner flat plane 311, similar to the principle of bicycle emergency braking, and then the main light fixture will be fastened quickly to achieve the quick installation.

Since the adjustment plane of the stepless speed governor 31 is a flat plane, and the inner plane of the support bracket 34 is also a flat plane, the adjustment angle has no dead angle and can be adjusted freely.

By using the embossing 352 on the fastening plane surface, the frictional force of the fastening piece 35 can be increased during locking, so that the locking force is stronger and the lock is tighter.

Two bolts are provided at the position where the bracket assembly is installed, and two bolt holes are provided at the bottom of the support bracket 34 directly opposite the bolts. Install the bolts in the bolt holes and pre-lock the big and small nuts and then rotate the light fixture left and right to the desired angle, and then lock the big and small nuts to complete the installation.

Figure 10:
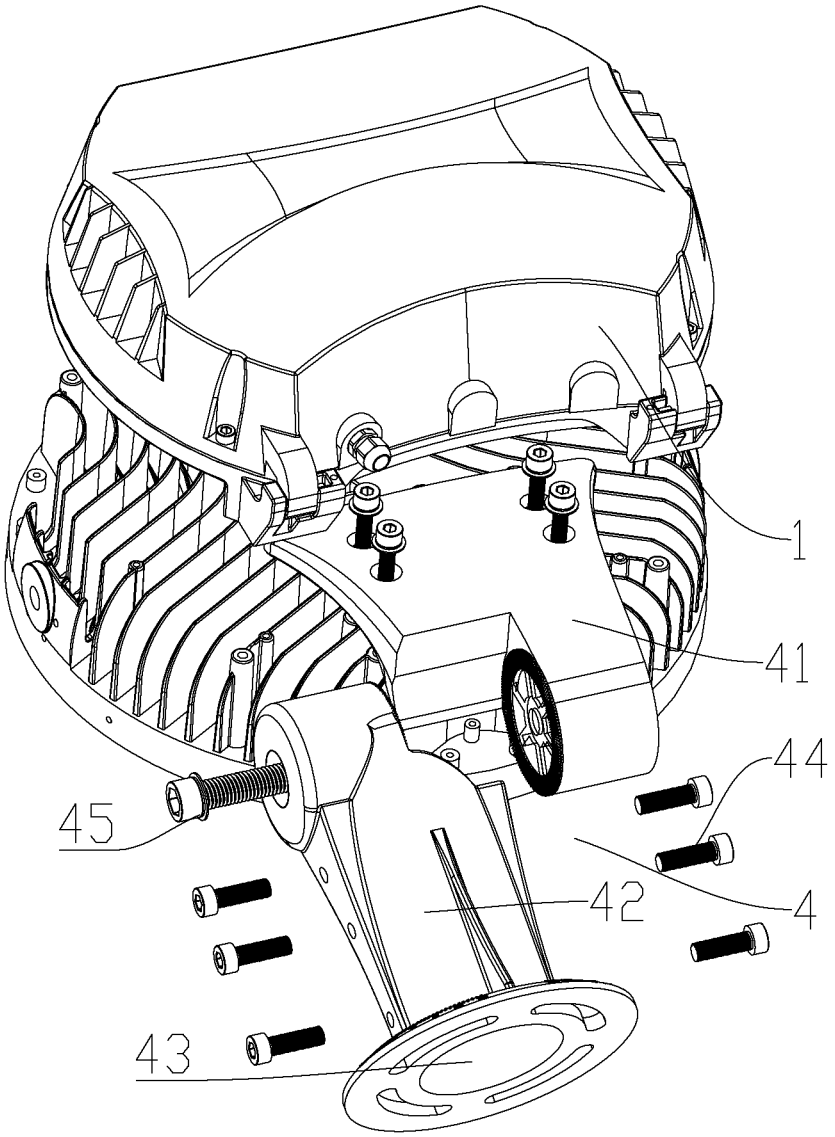
FIG. 10 is an exploded view of the structure of the second bracket assembly.

As shown in FIG. 10, in the second embodiment, the second bracket assembly 4 includes an upper base 41 and a base 42. The upper base 41 is fixedly connected to the light fixture body 1. The upper base 41 and the base 42 are meshed and fixed by a fixing bolt 45.

The lower right portion of the upper base 41 is convex, and the left side is provided with a ring-shaped left thread, and a bolt hole is provided in the center; the left upper portion of the base 42 is convex, and the right side is provided with a ring-shaped right thread, and a bolt is provided in the center. The left thread and the right thread are meshed and connected, and the fixing bolt 45 passes through the bolt holes of the upper base 41 and the base 42 so that the left thread and the right thread do not slide relatively. By adjusting the engagement angle of the left and right threads, changing the angle between the upper base 41 and the base 42, that is, the angle between the light fixture body 1 and the base 42 is changed.

The side face of the base 42 is provided with several positioning bolt holes. The bottom of the base 42 is provided with a step hole 43. The base 42 is sleeved on the upper part of the light pole through the step hole 43. The positioning bolt 44 is inserted into the positioning bolt hole and squeezes the light pole that is inside the base 42, so that the base 42 is fixedly connected to the light pole. The setting of the step hole 43 is suitable for a light pole of 60-86 mm, and the diameter of the light pole can be adjusted by adjusting the positioning bolt 44.

Figure 11:
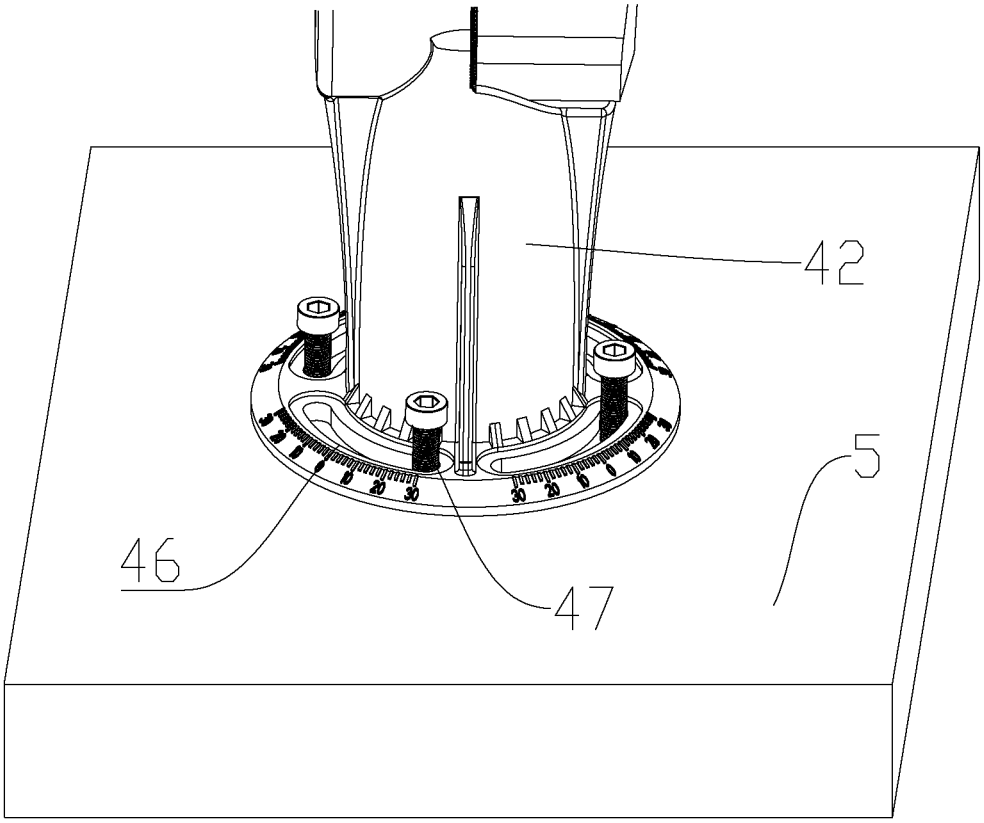
FIG. 11 is a schematic diagram of the installation of the second bracket assembly and the wall surface.

As shown in FIG. 11, OR install the second bracket assembly 4 on the wall surface 5. A plurality of arc-shaped angle adjusting groove 46 are provided at the bottom of the base 42. The adjusting bolts 47 passes through the angle adjusting groove 46 to fix the base 42 on the wall 5. By rotating e the base 42 and changing the position of the adjusting bolt 47 in the angle adjusting groove 46, illumination angle of the light fixture is changed thereby.

The above description is only the preferred embodiment of the present invention and is not intended to limit the present invention. Any modification, equivalent replacement, and improvement made within the spirit and principle of the present invention shall be included in the protection range of the present invention.

What is claimed is:

1. A deformable high-power light fixture, comprising a light fixture body (1) and a bracket assembly, wherein the light fixture body comprises a light source board (13), a heat-dissipating body (12), and a power supply box (11), the bracket assembly is detachably connected to the light fixture body (1) and is rotatable around the light fixture body (1) at a point of connection with the light fixture body (1);

the deformable high-power light fixture also comprises a second assembly (2) detachably connected to the light fixture body (1) and is disposed outside around the light fixture body (1) with the light fixture body (1) at the center; the light fixture body (1) has a circular shape, and the second assembly (2) has a shape that when the second assembly (2) is connected to the light fixture body (1), the light fixture body (1) together with the second assembly (2) has an overall shape different from the original circular shape of the light fixture (1);

the light fixture body (1) is provided with a glare shield (17);

the bracket assembly comprises a stepless speed dial (31), a support bracket (34) and a fastening piece (35); the stepless speed dial (31) is connected with the support bracket (34) by a fastening screw (37), and the support bracket (34) is connected to the power supply box (11) through a fixing bracket (32);

one side of the fastening piece (35) is provided with an embossing and a positioning pin (351), and another side of the fastening piece (35) is provided with a fixing nut (353), and the fastening piece (35) is fixed in position with respect to the support bracket (34) by inserting the positioning pin (351) into a first fixing hole of the support bracket (34), the support bracket (34) is provided with a second fixing hole where a handle screw (36) passes through the second fixing hole of the support bracket (34) and the fixing nut (353) of the fastening piece (35) to connect the support bracket (34) with the fastening piece (35); and the embossing is capable of contacting with the stepless speed dial (31); after an illumination angle of the light fixture (1) is adjusted, the handle screw (36) is tightened so as to bring the embossing of the fastening piece (35) to be in contact with the stepless speed dial (31) to achieve fastening effect.

2. The deformable high-power light fixture, according to claim 1, wherein the power supply box (11) is externally connected to a junction box (15), and the junction box (15) is fixed to the power supply box (11) by bolts.

3. A deformable high-power light fixture, according to claim 1, wherein a center position of the stepless speed dial (31) is provided with a through hole, and the through hole is provided with an adjustment cylinder (33); the fastening screw (37) passes through the through hole of the stepless speed dial (31), the adjustment cylinder (33), the support bracket (34) and the fixing bracket (32) so as to connect both the stepless speed dial (31) and the fixing bracket (32) to the support bracket (34).

* * * * *